United States Patent [19]

Wronka

[11] 4,345,332

[45] Aug. 17, 1982

[54] COVER FOR VESSEL FOR A METAL MELTING FURNACE, IN PARTICULAR AN ELECTRIC ARC FURNACE

[75] Inventor: Bodo Wronka, Duisburg, Fed. Rep. of Germany

[73] Assignee: Mannesmann DeMag AG, Duisburg, Fed. Rep. of Germany

[21] Appl. No.: 199,310

[22] Filed: Oct. 21, 1980

[30] Foreign Application Priority Data

Oct. 26, 1979 [DE] Fed. Rep. of Germany ..... 2943244

[51] Int. Cl.[3] ..... F27D 1/12

[52] U.S. Cl. ..... 373/74

[58] Field of Search ..... 13/32, 35

[56] References Cited

U.S. PATENT DOCUMENTS 3,967,048 6/1976 Longenecker ..... 13/32 X
4,207,060 6/1980 Zangs .

FOREIGN PATENT DOCUMENTS 253492 8/1963 Australia ..... 13/35
2546142 4/1977 Fed. Rep. of Germany .
2639378 3/1978 Fed. Rep. of Germany .
2817869 10/1979 Fed. Rep. of Germany .

*Primary Examiner*—Roy N. Envall, Jr.
*Attorney, Agent, or Firm*—Mandeville and Schweitzer

[57] ABSTRACT

The invention relates to a cover for a vessel for a metal melting furnace, in particular an electric arc furnace, with cooling-pipe coils connected to the cover frame and distributed across it, at least one of which cooling-pipe coils is exposed to the furnace hearth, all of which coils lie adjacent to each other.

12 Claims, 6 Drawing Figures

COVER FOR VESSEL FOR A METAL MELTING FURNACE, IN PARTICULAR AN ELECTRIC ARC FURNACE

BACKGROUND AND SUMMARY OF THE INVENTION

A vessel cover known from DE-OS No. 27 45 622 consists of an outer and an inner ring which are solidly connected with each other by means of supports. Freely exposed cooling coils are provided between the two rings on the side which faces the furnace hearth and are mounted on the rings by means of mounting brackets. The cooling-pipe coil consists of U-shaped winding pipes which lie closely against each other and are connected with each other through welding. The cooling-pipe coil is connected to a supply pipe through which the cooling water is fed under elevated pressure into the outer-most turn of the coil. The exit for the cooling water is provided at the inner turn of the cooling-pipe coil. The space between the inner ring and the electrodes is filled out with a refractory lining which is customarily arranged around the electrodes.

Experience has shown that when this vessel cover is used, material difficulties ensue in handling the cover during maintenance work because the entire cover has to be removed from the furnace vessel after switching off the cooling-water connections. In case of repairs at the infeed or the individual cooling elements, extensive dismantling has been necessary because the cover is erected as a compact unit. Besides, a complete replacement cover had to be available.

It is therefore the object of the present invention to build a vessel cover, of the general type mentioned above, which does not have the enumerated disadvantages, but one which is designed in such a way that the inner lined cover center or the cooling unit may, if necessary, be constructed separately.

This object is achieved according to the invention through the features of the cooling pipe coil which is connected to the cover frame and lies exposed toward the furnace hearth, which when viewed from the top leaves an area open above the center of the container cover, and is formed as a self-supporting unit; the outer cover frame is connected with a frame from which it may be released; the frame is arranged above the cooling coil in a plane extending parallel to the cover frame and is connectable to a hoisting unlt for the arc furnace cover; the refraction-lined center is arranged at the frame and is suspended and detachable in a manner whereby the outer circumference of the cover center fits onto the inner circumference of the cooling coil.

Thus, in accordance with the invention, maintenance work is materially facilitated, thereby reducing operating costs. In this regard the arrangement of a sub-frame is essential, to which subframe are mounted, independently of each other, the self-supporting cooling-pipe coil and the lined cover center.

For repair work at the cover in-feed, the connection between the subframe and the cover hoist unit is released and the lined cover center is lifted off, without the subframe, with the help of a crane, by connecting the loading means of the crane to the bent support arm of the cover center. The cover center can be set aside on the repair stand.

In this manner, the cooling-pipe coil, which is connected to the cooling circuit, rests on the furnace vessel. During repair a replacement cover center may be brought above the furnace vessel and may be connected with both the subframe, which rests against the vessel, and the cooled cover element.

Should there be repair work required at the cooling unit, the lined cover center with its ring-shaped frame may be swivelled away so as to make possible repairs to the cooling coils at the furnace or at a repair stand.

Finally, it is possible to lift the complete furnace cover together with subframe off the furnace vessel.

DESCRIPTION OF THE DRAWINGS

The present invention is explained through the accompanying drawings of an example of the furnace cover in which.

DETAILED DESCRIPTION OF THE DRAWINGS

Figures 1, 2, 3:
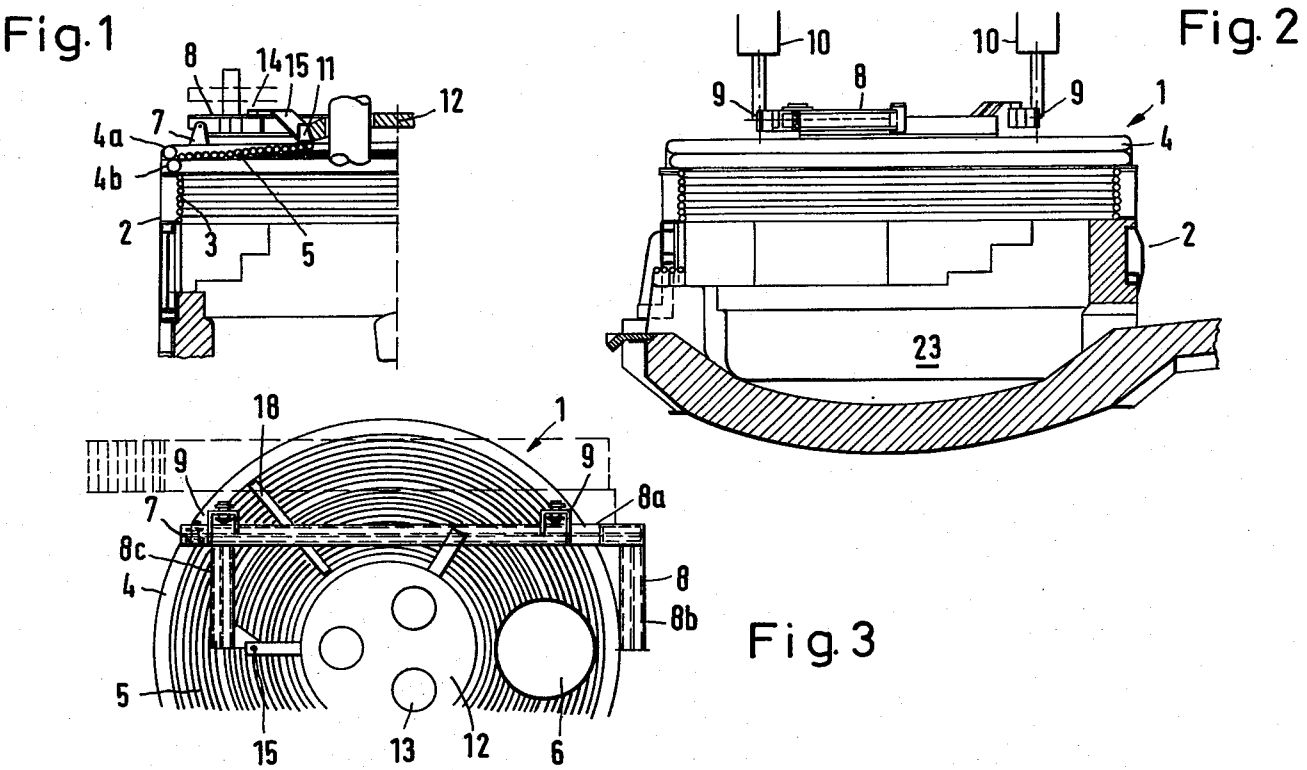
FIG. 1 is a part of an arc furnace in axial profile with the furnace cover constructed according to the invention.
FIG. 3 is a plan view of the cover of FIG. 1.
FIG. 2 is the arc furnace of FIG. 1 as viewed from the side.

The cover 1, as illustrated in FIGS. 1 and 2 (as well as FIG. 3, as an exemplary embodiment) shows a cover frame 4 consisting of two adjacent thick-walled pipes 4*a* and 4*b*. Cooling-pipe coils 5 of ring-shaped winding pipes, exposed to the furnace hearth, are connected to the cover frame 4. The outermost turn of the cooling-pipe coil 5 may, for instance, be connected through spot welding with the circular-shaped cover frame 4. The turns of the cooling-pipe coil 5 lie adjacent to each other and concentrically surround the center point of the furnace cover 1 (FIG. 3). An open circular-shaped area is provided in the area of the center of the vessel cover.

The furnace cover 1 is supported with its frame 4 against the edge of the furnace vessel 2, which vessel has a cooled pipe wall 3 in its upper part.

Figure 6:
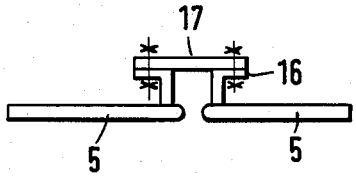
FIG. 6 is a detail of the connection of two cooling coils of the cover of the invention.

The cooling coil 5 may consist of two segment-shaped elements between which a radial gap of 30 mm is provided, which is bridged conductively by means of supports 16 mounted to the adjacent cooling-coil edges, as well as copper plates 17 (FIG. 6). In this manner the two segment-shaped cooling-coil elements are joined together.

As may be seen from FIG. 1, the turns of the cooling coil 5 are arranged in such a manner that the cooling coil is formed as a shallow cone. The cooling coil, as well as the joined cooling coils, form a self-supporting structure.

As the illustrated example shows, the turns of the cooling coil 5, for reasons of solidity, may be connected with radially arranged bars through spot welding.

The pipes 4*a* and 4*b* forming the outer cover frame 4 are connected to the lines of cooling-means circuit (not illustrated) and serve at the same time as cooling-means distributor for the cover cooling-pipe coil 5. The cooling-means connections (not illustrated) of the turns are arranged in such a manner that towards the center of the cover the distance between the connecting points steadily lengthens so that the fed-in cooling water is distributed evenly across the entire cooling coil or, as applicable, supplies even sized area sections of the furnace cover through each cooling-water connection.

In FIG. 3 an opening 6 is provided in the vessel cover 1 for an exhaust elbow (not illustrated).

Four holders or hooks 7, arranged symmetrically to the lateral axis of the vessel cover 1, are mounted to the upper side of the cover frame 4, and serve to connect the cooling-pipe coil to a subframe. The subframe 8 is to lift the cover 1 or its elements, as is described in more detail hereinafter.

The subframe consists of four box girders or beams 8*a*, 8*b*, 8*c*, and 8*d*, which are insulated and bolted to each other. FIG. 3 only illustrates a mirror-symmetrical half of the subframe. The subframe 8 is provided with mounting brackets 9 at its corner areas through which it is connectable to the lifting arms 10 of a hoisting unit (not illustrated). The box girders or beams 8*a* to 8*d* are provided with connections for cooling water so that the subframe is also connected to a cooling circuit during the furnace operation.

The inner cover ring 11 is connected to a cooling circuit separate from the remaining cooling system.

Bent support arms 15 are welded onto the inner cover rings 11. A hollow inner cover ring 11 is supported at the lower element of the bent support arms 15 (by a not illustrated insulation). This inner cover ring 11 with a, for instance, trapezoid-shaped cross section, is connected with a curved, lined cover center 12 in which openings 13 (FIG. 3) are provided for electrodes.

The inner cover ring 11 with the lined cover center 12 is connected through the support arms 15 to the subframe 8 through connections 14.

Through this arrangement it is possible, after the cooling-water lines to the furnace cover and to the subframe as well as to the inner cover ring 11 have been released, to lift off the complete furnace cover 1 by means of a crane and, if need be, to stand it aside on a repair stand. Furthermore, it is possible after releasing the bolts from the mounting brackets 9 (FIG. 3) to remove only the inner cover ring 11 together with the lined cover center 12 from the vessel cover or the subframe 8, if, for instance, repair of the infeed is required. In that instance, the cooling-pipe coil 5 connected to the cooling circuit rests on the furnace vessel 2.

In case of need it is also possible to release the connection (hooks 7) between the subframe 8 and the cover frame 4 and to lift off only the cooling coil 5 and deposit it on the repair stand, if only the cooling coil is to be repaired.

Figure 4:
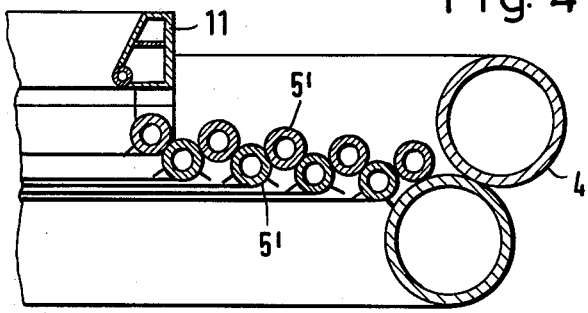
FIG. 4 is a detail, in axial profile, of a modified furnace cover according to the invention.

FIG. 4 shows a modification of the cooling-pipe coil 5, where the pipes 5' are arranged, alternatively, mutually staggered in height.

Figure 5:
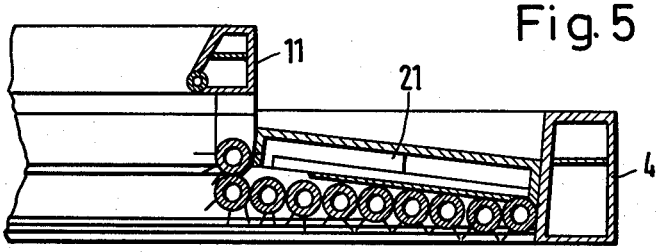
FIG. 5 is a detail, in axial profile, of a modification of the furnace cover according to the invention.

FIG. 5 shows a further possible arrangement of the cooling-pipe coil, where the pipes are mounted to a cooling box 21 which is arranged by that area of cover 1 which is averted from the furnace hearth 23.

The individual pipes, illustrated in FIG. 4 as well as FIG. 5, of the cooling coils are provided, at the side toward the furnace hearth, with protrusions in the shape of knubs, pins, ribs, or such, which would further the formation of a slag layer on the pipe surface. This layer forms automatically from the slag splashing during the furnace operation. The layer acts as thermical and electrical insulation. It has one more advantage in that it renews itself if its elements peel off during the course of operation, for instance in consequence of local overheating.

FIG. 6 shows a connection of two adjacent cooling coils 5. A small radial gap is provided between the coils 5. This gap is conductively bridged by means of supports 16 mounted to the adjacent cooling-coil edges as well as by means of a flat iron bar 17 solidly connected with the supports 16.

I claim:

1. A metal melting furnace cover particularly suitable for an electric arc furnace comprising
   (a) an outer cover frame,
   (b) a cooling coil attached to said cover frame,
   (c) the turns of said cooling coil being distributed generally across said cover frame,
   (d) said cooling coil being formed as a self-supporting unit and having a centrally situated opening,
   (e) a subframe,
   (f) frame connecting means releasably connecting said subframe to said outer frame,
   (g) said subframe extending generally in a plane parallel to the outer cover frame and being connectable to a hoisting device,
   (h) a center disposed within the centrally situated opening of said cooling coil,
   (i) said center being comprised at least partially of refractory material, and
   (j) releasable, center suspending means for suspending said center from said subframe.

2. The cover according to claim 1, wherein said center fits removably on the inner circumference of the cooling coil.

3. The cover according to claim 1, wherein said center includes
   (a) an inner cover ring located on the periphery of the center, and
   (b) openings for electrodes,
   (c) said inner cover ring fitting removably onto the inner circumference of the cooling coil.

4. The cover according to claim 2, wherein said inner cover ring is releasably suspended from said subframe.

5. The cover according to claim 1, further comprising
   (a) a plurality of cooling pipe coils joined together and forming a self-supporting unit.

6. The cover according to claim 3, characterized in that
   (a) an electric and heat-insulating layer is provided between the inner cover ring of the cover center and the inner edge of the cooling coil.

7. The cover according to claim 3, characterized in that
   (a) the inner cover ring is hollow and is connected to a separate cooling circuit.

8. The cover according to claim 4, characterized in that
   (a) a narrow gap is provided between each of the cooling pipe coils, which gap is bridged by means of conductive supports mounted to the adjacent cooling-coil edges.

9. The cover according to claim 8, wherein the turns of said cooling coil are U-shaped.

10. The cover according to claim 1, characterized in that
   (a) the center may be lifted off of the furnace independently of the other furnace-cover elements.

11. The cover according to claim 1, characterized in that
   (a) the cover frame with the cooling coil may be lifted off of the furnace independently of the center.

12. The cover according to claim 1, characterized in that
   (a) the complete furnace cover as a whole may be lifted off the furnace vessel.

* * * * *